US012077888B2

(12) United States Patent
Vitarana et al.

(10) Patent No.: US 12,077,888 B2
(45) Date of Patent: Sep. 3, 2024

(54) FABRIC WITH VARIABLE FABRIC PROPERTIES

(71) Applicant: MAS INNOVATION (PRIVATE) LIMITED, Battaramulla (LK)

(72) Inventors: Ranil Kirthi Vitarana, Battaramulla (LK); Sithila Dassanayake, Battaramulla (LK); Dilru Roshan Ratnaweera, Battaramulla (LK); Hetti Arachchige Malaka Chathuranga Perera, Battaramulla (LK); Dodangodage Indika Sanjeewa Wickramaratne, Battaramulla (LK)

(73) Assignee: MAS INNOVATION (PRIVATE) LIMITED, Battaramulla (LK)

( * ) Notice: Subject to any disclaimer, the term of this patent is extended or adjusted under 35 U.S.C. 154(b) by 66 days.

(21) Appl. No.: 17/819,356

(22) Filed: Aug. 12, 2022

(65) Prior Publication Data

US 2023/0010185 A1 Jan. 12, 2023

Related U.S. Application Data

(63) Continuation of application No. PCT/SG2021/050609, filed on Oct. 11, 2021.

(30) Foreign Application Priority Data

Aug. 24, 2021 (WO) ..... PCT/SG2021/050494
Aug. 24, 2021 (WO) ..... PCT/SG2021/050495

(51) Int. Cl.
*D04B 1/10* (2006.01)
*A41C 3/12* (2006.01)
(Continued)

(52) U.S. Cl.
CPC ..... *D04B 1/108* (2013.01); *A41C 3/12* (2013.01); *D04B 1/12* (2013.01); *D04B 1/18* (2013.01);
(Continued)

(58) Field of Classification Search
CPC . D04B 1/108; D04B 1/12; D04B 1/18; D04B 1/24; D04B 1/10; D10B 2403/022
See application file for complete search history.

(56) References Cited

U.S. PATENT DOCUMENTS 4,044,575 A 8/1977 Krug
5,422,153 A 6/1995 Miyamoto
(Continued)

FOREIGN PATENT DOCUMENTS

CN 101849054 A 9/2010
CN 106192189 A 12/2016
(Continued)

OTHER PUBLICATIONS

International Search Report issued for corresponding International Patent Application No. PCT/SG2021/050494, dated Nov. 11, 2021 (6 pages).
(Continued)

*Primary Examiner* — Danny Worrell
(74) *Attorney, Agent, or Firm* — Osha Bergman Watanabe & Burton LLP

(57) ABSTRACT

Disclosed herein is a fabric having variable fabric properties, the fabric comprising a plurality of fabric regions, each fabric region formed from at least one set of yarns; and the sets of yarns of the fabric regions belonging to a common family of thermoplastic polymer materials, wherein the fabric is moulded and the fabric regions have different fabric properties from each other.

13 Claims, 5 Drawing Sheets

(51) Int. Cl.

| | |
|---|---|
| ***D04B 1/12*** | (2006.01) |
| ***D04B 1/18*** | (2006.01) |
| ***D04B 1/24*** | (2006.01) |

(52) U.S. Cl.
CPC ..... *D04B 1/24* (2013.01); *D10B 2401/041* (2013.01); *D10B 2403/022* (2013.01); *D10B 2501/02* (2013.01)

(56) References Cited

U.S. PATENT DOCUMENTS

| | | | | |
|---|---|---|---|---|
| 6,779,369 | B2 | 8/2004 | Shepherd | |
| 7,028,509 | B2 * | 4/2006 | Mitchell | A41C 3/0014 66/196 |
| 7,214,120 | B2 * | 5/2007 | Kaye | A41C 3/10 450/39 |
| 7,913,520 | B1 | 3/2011 | Chen et al. | |
| 9,637,847 | B2 | 5/2017 | Terai et al. | |
| 9,677,209 | B2 | 6/2017 | Daube et al. | |
| 10,640,896 | B2 * | 5/2020 | Barnes | D04B 1/18 |
| 2004/0097151 | A1 | 5/2004 | McMurray | |
| 2004/0168479 | A1 * | 9/2004 | McMurray | D04B 1/16 66/202 |
| 2007/0238392 | A1 * | 10/2007 | Starbuck | D04B 1/18 66/149 R |
| 2013/0209743 | A1 | 8/2013 | Deguchi et al. | |
| 2016/0289872 | A1 | 10/2016 | Kieren et al. | |
| 2019/0062963 | A1 | 2/2019 | Heiner et al. | |
| 2019/0062964 | A1 | 2/2019 | Heiner et al. | |
| 2020/0001566 | A1 * | 1/2020 | Lin | B32B 3/263 |
| 2020/0002855 | A1 | 1/2020 | Aristizabal et al. | |

FOREIGN PATENT DOCUMENTS

| | | | |
|---|---|---|---|
| CN | 105442163 | B | 1/2018 |
| CN | 208774210 | U | 4/2019 |
| CN | 110295452 | A | 10/2019 |
| DE | 29816223 | U1 | 1/1999 |
| DE | 102018110773 | A1 | 2/2019 |
| EP | 1203837 | B1 | 7/2004 |
| EP | 2218808 | A1 | 8/2010 |
| EP | 2628833 | B1 | 3/2016 |
| EP | 2584080 | B1 | 6/2017 |
| JP | 2004019035 | A | 1/2004 |
| JP | 2016-117955 | A | 6/2016 |
| WO | 2016/197051 | A1 | 12/2016 |
| WO | 2019/197319 | A1 | 10/2019 |
| WO | 2022/086438 | A1 | 4/2022 |
| WO | 2022/086439 | A1 | 4/2022 |

OTHER PUBLICATIONS

Written Opinion issued for corresponding International Patent Application No. PCT/SG2021/050494, dated Nov. 11, 2021 (8 pages).
International Search Report issued for corresponding International Patent Application No. PCT/SG2021/050495, dated Nov. 11, 2021 (6 pages).
Written Opinion issued for corresponding International Patent Application No. PCT/SG2021/050495, dated Nov. 11, 2021 (7 pages).
International Search Report issued for corresponding International Patent Application No. PCT/SG2021/050609, dated Oct. 11, 2021 (5 pages).
Written Opinion issued for corresponding International Patent Application No. PCT/SG2021/050609, dated Oct. 11, 2021 (7 pages).
International Preliminary Report on Patentability issued in Application No. PCT/SG2021/050609, dated May 4, 2023 (9 pages).

* cited by examiner

FABRIC WITH VARIABLE FABRIC PROPERTIES

CROSS REFERENCE TO RELATED APPLICATIONS

The current invention claims the benefits of Singapore Patent Application No. 10202010445Y filed on 21 Oct. 2020, PCT Patent Application No. PCT/SG2021/050494 filed on 24 Aug. 2021, and PCT Patent Application No. PCT/SG2021/050495 filed on 24 Aug. 2021, all of which are incorporated in their entirety by reference herein.

TECHNICAL FIELD

The current invention relates to a fabric or textile material product that has variable fabric properties, such as density, thickness, and/or stiffness, and is suitable for use in garments such as bras, shoulder pads, knee garments, and the like.

BACKGROUND

The listing or discussion of a prior-published document in this specification should not necessarily be taken as an acknowledgement that the document is part of the state of the art or is common general knowledge.

Current bras or bra cups, which are made of various materials including foam or polyurethane, are not sustainable in many ways. For example, the use of the starting raw materials and the method of manufacture is not sustainable, and the final product also causes problems in terms of its disposal once its useful life has been completed. As such, there is a need to find alternative products and methods of manufacture that are at least more sustainable in terms of manufacture and use of raw materials.

BRIEF SUMMARY

The current invention provides a sustainable alternative solution for current bra cups (and associated products) as well as other suitable garments or fabric/textile products. The invention relates to a fabric or textile material that has variation in fabric properties, such as density, thickness, and/or stiffness. The fabric has a plurality of fabric regions, each fabric region formed from at least one set of yarns, such as by knitting. For example, the fabric regions may be formed by flat knitting and the fabric may be flat or has some shape such as to conform to the user's body. The fabric is moulded to and the fabric regions have different fabric properties from each other. For example, the fabric regions may include a wire fabric region that has been stiffened from moulding and has high density and stiffness. The moulded fabric can be used to form a bra cup and the wire fabric region can be created for supporting a user's breast.

The materials used in the moulded fabric belong to the same family of thermoplastic polymer materials (i.e. mono-polymer materials) to facilitate recyclability. Preferably, the materials are sustainable materials (e.g. recycled materials, bio-based materials, and recyclable materials). The mono-polymer materials enable easy recycling without complicated material segregation and separation processes and the mono-polymer materials themselves can already be recycled materials. This enables circularity of the materials and improves the circular material use rate, thus furthering sustainability of the materials.

The invention will now be described by reference to the following numbered clauses.

1. A fabric having variable fabric properties, the fabric comprising:
   a plurality of fabric regions, each fabric region formed from at least one set of yarns; and
   the sets of yarns of the fabric regions belonging to a common family of thermoplastic polymer materials,
   wherein the fabric is moulded and the fabric regions have different fabric properties from each other.

2. The fabric according to clause 1, wherein the fabric properties comprise at least one of density, thickness, and stiffness.

3. The fabric according to clause 1 or 2, wherein the different fabric properties of the fabric regions are formed by varying thicknesses of the fabric regions and/or varying compression of the fabric during moulding.

4. The fabric according to clause 3, wherein the thicknesses of the fabric regions are varied by varying formation of the fabric from the respective sets of yarns.

5. The fabric according to clause 4, wherein the thicknesses of the fabric regions are varied by varying at least one of:
   the density of tuck stitches of the sets of yarns of the fabric regions;
   the thickness of the sets of yarns of the fabric regions; and
   knit structure of the fabric regions.

6. The fabric according to clause 5, wherein the knit structure is formed by inlay knitting.

7. The fabric according to any one of clauses 1 to 6, wherein a fabric region comprises: a first surface layer formed from a first set of yarns;
   a second surface layer formed from a second set of yarns; and
   a set of spacer yarns between the first and second surface layers.

8. The fabric according to clause 7, wherein each of the first and second sets of yarns comprises an elastic material.

9. The fabric according to clause 7 or 8, wherein each of the first and second sets of yarns comprises a main yarn and a plating yarn, the main yarn forming an outer surface and the plating yarn forming an interior surface of the respective first and second surface layers.

10. The fabric according to clause 9, wherein the plating yarn of each of the first and second sets of yarns has elastic properties.

11. The fabric according to any one of clauses 1 to 10, wherein the fabric regions are arranged to provide a bra cup or a bra cookie for making a bra.

12. The fabric according to clause 11, wherein the fabric regions comprise a first, a second, and a third fabric region, such that:
   the first fabric region corresponds to an outer peripheral region of the bra cup or bra cookie and has a lower thickness than the second fabric region;
   the second fabric region corresponds to a region of the bra cup or bra cookie between the first and third regions, and has a lower thickness than the third fabric region; and
   the third fabric region corresponds to a central region of the bra cup or bra cookie and has a higher thickness than the first and second fabric regions.

13. The fabric according to clause 11 or 12, wherein the fabric regions comprise a wire fabric region that has been stiffened from moulding, the wire fabric region arranged for supporting a user's breast.

14. The fabric according to any one of clauses 1 to 10, wherein the fabric regions are arranged to provide a knee garment.

15. A garment comprising a fabric having variable fabric properties as defined in any one of clauses 1 to 14.

16. The garment according to clause 15, wherein the garment is a bra or knee garment.

BRIEF DESCRIPTION OF THE DRAWINGS

FIG. 8 shows an example of a moulded bra cup.

DETAILED DESCRIPTION

Figure 1:
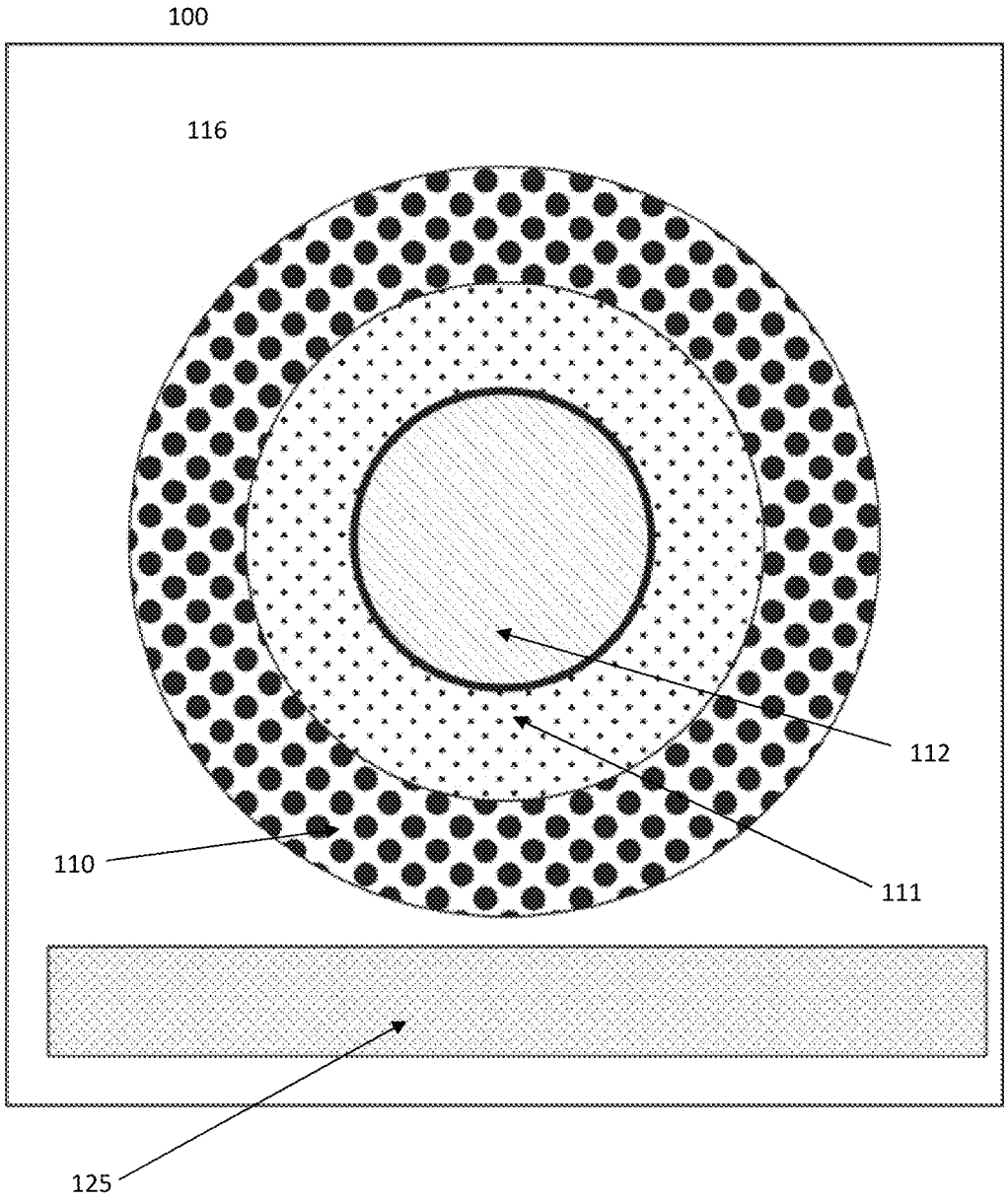
FIG. 1 shows a fabric suitable for a bra cup, and depicts fabric regions having different fabric properties, particularly densities of tuck stitches.

In a first aspect of the invention, there is provided a fabric having variable fabric properties, the fabric comprising: a plurality of fabric regions, each fabric region formed from at least one set of yarns; and the sets of yarns of the fabric regions belonging to a common family of thermoplastic polymer materials, wherein the fabric is moulded and the fabric regions have different fabric properties from each other. The variable fabric properties comprise at least one of density, thickness, and stiffness.

In embodiments herein, the word "comprising" may be interpreted as requiring the features mentioned, but not limiting the presence of other features. Alternatively, the word "comprising" may also relate to the situation where only the components/features listed are intended to be present (e.g. the word "comprising" may be replaced by the phrases "consists of" or "consists essentially of"). It is explicitly contemplated that both the broader and narrower interpretations can be applied to all aspects and embodiments of the present invention. In other words, the word "comprising" and synonyms thereof may be replaced by the phrase "consisting of" or the phrase "consists essentially of" or synonyms thereof and vice versa.

The phrase, "consists essentially of" and its pseudonyms may be interpreted herein to refer to a material where minor impurities may be present. For example, the material may be greater than or equal to 90% pure, such as greater than 95% pure, such as greater than 97% pure, such as greater than 99% pure, such as greater than 99.9% pure, such as greater than 99.99% pure, such as greater than 99.999% pure, such as 100% pure. When used herein, the term "substantially identical" is intended to refer to a dimension that is essentially identical, but for variations introduced by the knitting machine. For example, the term may mean that a dimension varies by less than 5%, such as less than 2%, such as less than 1%, such as less than 0.5%, such as less than 0.05%, such as the dimension is essentially uniform.

The sets of yarns that form the fabric regions belong to the same family of thermoplastic polymer materials. Thermoplastic polymer materials are a class of polymers that can be softened and melted by the application of heat, and can be processed in the heat-softened state, such as for moulding. The family of thermoplastic polymer materials may be polyamides, polyester, polyolefin, and polyurethane. In addition, each set of yarns may be formed from one or more materials belonging to the same family of thermoplastic polymer materials. For example, a set of yarns may be formed from inelastic yarns, elastic yarns, or a combination of both. That is, the set of yarns may be formed using any suitable material for use in textiles that may or may not include an elastic material as the entirety of the yarns or as part of blended yarns.

Any suitable textile yarns may be used in the sets of yarns, provided they belong to the same family of thermoplastic polymer materials. However, specific types of yarns may be required, depending on the desired functionality. For example, the yarns may be selected for wicking, breathability, water repellent, liquid retaining, anti-microbial, anti-odour and/or thermal comfort properties. The yarn selections may be done in a manner to enable various properties of the final product via different types of yarns made out from the same family of thermoplastic polymer materials. Each component of the final product may comprise different yarns with different properties. These different yarns are used and knitted (such as by a knitting machine) in certain ways which will behave differently during moulding, giving required fabric properties in the final product. For example, the yarns may differ by at least one of yarn count, filament count, length of polymer chain, glass transition temperature, and material modulus or stiffness.

The thickness variation of the fabric regions is determined by the density of tuck stitches (or tuck stitch density or weft directional tuck frequency). If the tuck stiches are closer to each other (all needle tuck) then the thickness is high. If the tuck stiches are far from each other, then the thickness will be low. This frequency can go down to the level of no tuck stiches at all. When used herein, the density of tuck stitches along a course affects the thickness of the course itself across its length. For example, the density of tuck stitches may be the same across the course length. In this case, the thickness of the particular course will be even across its length, though it may be thicker or thinner than adjacent courses even when they make use of the same thickness of spacer yarn, as the adjacent courses may use a higher or lower density of tuck stitches across their length. Alternatively, the density of the tuck stitches may vary along the course. For example, there may be a low density (or no) tuck stitches at peripheral regions of the course, while the central region of the course may have a high density of tuck stitches. As such, the course shows a thicker middle than peripheral regions. As will be appreciated any variation of this the above is possible to achieve the desired thickness across the courses.

The thickness of the fabric regions may also be controlled by varying the thickness of the sets of yarns of the fabric regions, such as spacer yarns. This may enable courses that have an substantially identical density of tuck stitches to nevertheless have a different thickness due to the difference in thickness of the spacer yarns used in the respective courses. Examples of thickness of spacer yarns that may be used herein may be from 10 to 700 Denier. For example, a thin spacer yarn may have a thickness of from 10 to 50 Denier, such as from 15 to 40 Denier, such as about 17 Denier. A medium-thickness spacer yarn may have a thickness of from 50 to 300 Denier, while a thick spacer yarn may have a thickness of from 300 to 700 Denier, such as from 400 to 600 Denier. In addition, if one wants to generate a very thin fabric region, then this may be possible through the use of a set of spacer yarns that includes yarns that are elastic or stretchable in nature.

FIG. 1 depicts a pattern for a fabric 100 according to the current invention. The fabric 100 of FIG. 1 relates specifically to a bra cup. The bra cup fabric 100 has three fabric regions 110, 111, and 112 with different fabric properties from each other, such as by way of density, thickness, and/or stiffness. For example, the first fabric region 110 has the lowest thickness and lowest density of tuck stiches, the second fabric region 111 has a higher density of tuck stiches than the first fabric region 110, and the third fabric region 112 has the highest density of tuck stiches. Further, the first fabric region 110 may have the lowest thickness, the second fabric region 111 may have a greater thickness than the first fabric region 110, and the third fabric region 112 may have an even greater thickness than the second fabric region 111.

For a bra cup or bra cookie, there may be an area that is preferably thinner, where support is needed, but concealment is not significantly required (such as the main body of a breast). However, there may also be an area where concealment is desired, such as in the area of the nipples and this area may require a much thicker material than for other parts of the bra in order to provide the desired concealment. This can be readily provided, as shown in FIG. 1, where the fabric 100 with variable mass density generates the third fabric region 112 suitable for nipple concealment, with the second fabric region 111 being suitable to cover the areola, and the first fabric region 110 being suitable for the rest of the breast volume/area. The bra cup fabric 100 thus provides a lightweight and comfortable bra while ensuring sufficient nipple concealment and breast support.

It will be appreciated that in FIG. 1, there may be a fourth fabric region 116 which may correspond to the thinnest possible material and may be entirely flat without any variation in fabric properties (e.g. the thickness is constant and the fourth fabric region 116 may be formed from a single jersey, bird's eye jacquard and the like). For example, the fourth fabric region 116 represents the base of the fabric 100 and may have an interlock knit structure.

The bra cup fabric 100 in FIG. 1 may further include a wire fabric region 125 to create the functionality of a bra underwire. The wire fabric region 125 is formed of a material from the same family of thermoplastic polymer materials as the yarns of the other fabric regions 110, 111, and 112. More specifically, the wire fabric region 125 is formed of a thermoplastic polymer material that will stiffen upon heating during the moulding process, thus conferring stiffer fabric properties to the wire fabric region 125 compared to the other fabric regions. In some embodiments, a tunnel is formed or knitted in the fabric 100, such as in the fourth region 116 which corresponds to the thinnest area of the fabric 100, and the wire element (made from the same family of thermoplastic polymer materials) is separately inserted into the tunnel to form the wire fabric region 125. In some embodiments, the wire element is not separately attached but the wire fabric region 125 is instead formed or knitted directly into the fabric 100 using a material in the same family of thermoplastic polymer materials as the fabric 100. The wire fabric region 125 will impart stiffness to the area of the fabric 100 after moulding, and the stiff wire fabric region 125 will have the shape of and will perform as a normal bra underwire, especially to provide an area for additional support for a user's breasts.

The different fabric properties of the fabric regions may be formed by varying thicknesses of the fabric regions and/or varying compression of the fabric during moulding. For example, the thicknesses of the fabric regions are varied by varying formation of the fabric from the respective sets of yarns. The thicknesses of the fabric regions may be varied by varying at least one of: the density of tuck stitches of the sets of yarns of the fabric regions; the thickness of the sets of yarns of the fabric regions; and knit structure of the fabric regions. For example, the knit structure is formed by inlay knitting.

In some embodiments, a fabric region is created to have bi-directional thickness variation. The frequency of tuck stitches can control the thickness of the fabric region in one direction (e.g. in the X direction), while the yarn count (diameter/thickness) of the yarns (e.g. spacer yarns) used allows for the thickness of the fabric region to be controlled in the other direction (e.g. in the Y direction). Thus, a combination of frequency of tuck stiches and the different (various thickness) spacer yarns used along/across the fabric, allows for thickness variation in both the X and Y directions.

Figure 2:
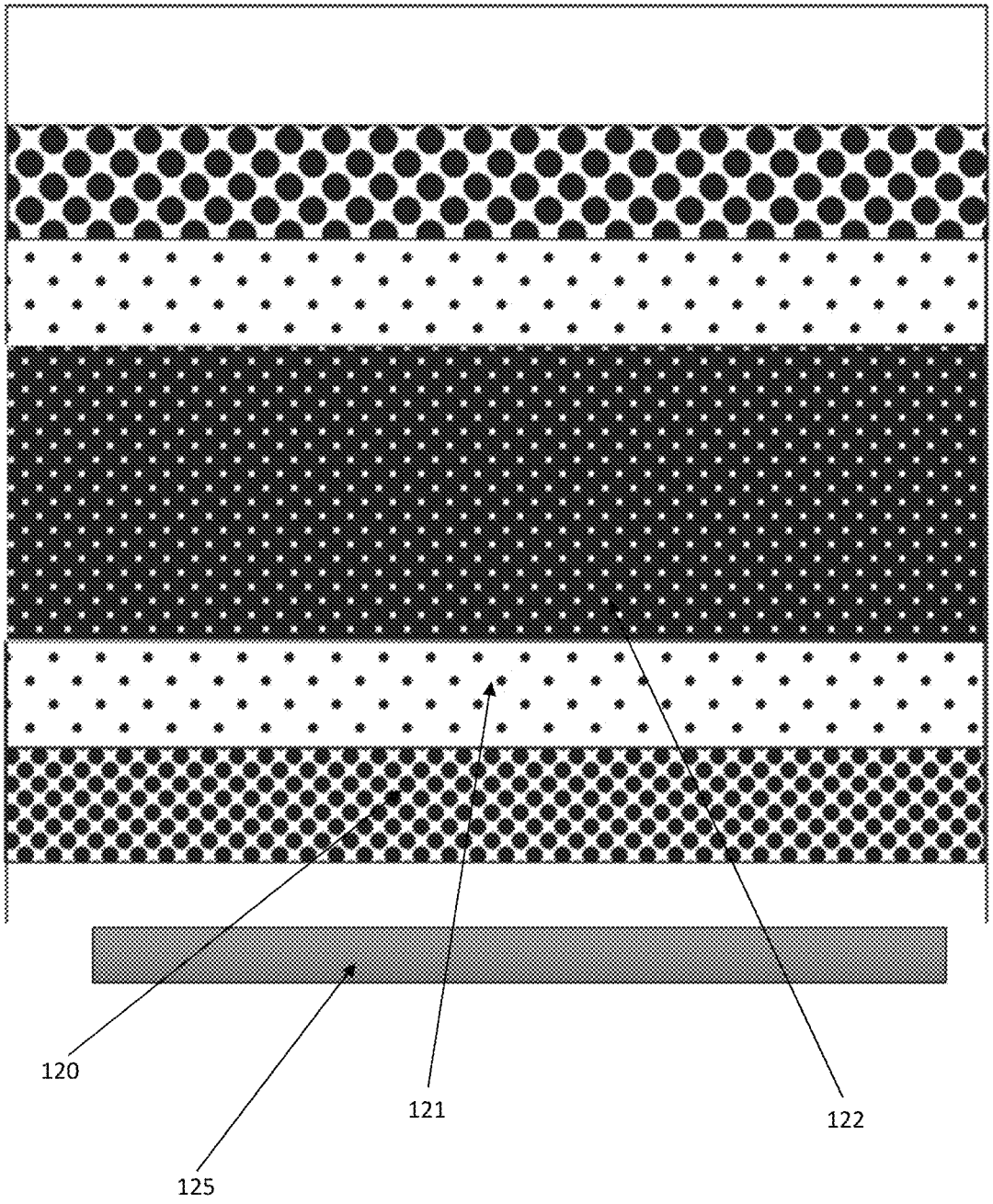
FIG. 2 shows a fabric suitable for a bra cup, and depicts fabric regions having different fabric properties, particularly different spacer yarn thicknesses.

In addition or alternative to the variable tuck stitch density for the fabric regions 110, 111, and 112, the thickness of the fabric 100 can also be influenced by type of material, such as spacer yarns, used to generate the tuck stitches. FIG. 2 depicts a fabric 100 having three fabric regions 120, 121, and 122 with different spacer yarn thicknesses. The first fabric region 120 uses thin spacer yarns with the smallest yarn count, the second fabric region 121 uses medium-thickness spacer yarns with a higher yarn count than the first fabric region 120, while the third fabric region 122 uses thick spacer yarns with the highest yarn count. More particularly, the spacer yarns used in the fabric regions 120, 121, and 122 belong to the same family of thermoplastic polymer materials. As shown in FIG. 2, varying the thicknesses of the spacer yarns in the fabric regions 120, 121, and 122 allows for a desirable thickness variation to be obtained across the entirety of the bra cup fabric 100, thereby generating a unitary object that can provide support to a user's breast, while at the same time providing suitable nipple concealment.

As shown in FIGS. 1 and 2, controlling the tuck stitch density and the thickness of the spacer yarns used, allows the fabric 100 to form plural fabric regions with different fabric properties from each other that would be suitable for different purposes. As described above, for a bra cup or bra cookie, the third fabric region 112 is suitable for nipple concealment, the second fabric region 111 is suitable to cover the areola, and the first fabric region 110 is suitable for the rest of the breast volume/area.

As will be appreciated, the design used in FIGS. 1 and 2 is one of many possible variations and, while three fabric regions with variable fabric properties may be used in other embodiments, the thickest one may not always occupy the central region. For example, the thickness might vary from one side to the other continuously. As will also be appreciated, any suitable number of fabric regions may be used to provide a desired fabric 100.

Figure 3:
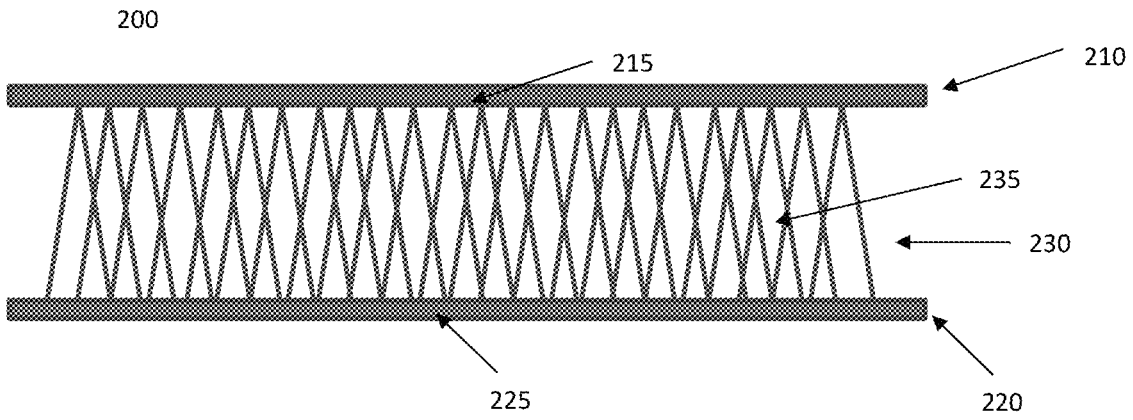
FIG. 3 shows a suitable cross-section for a fabric of the invention, in which the fabric region has first and second surface layers are formed from respective sets of yarns.
Figure 4:
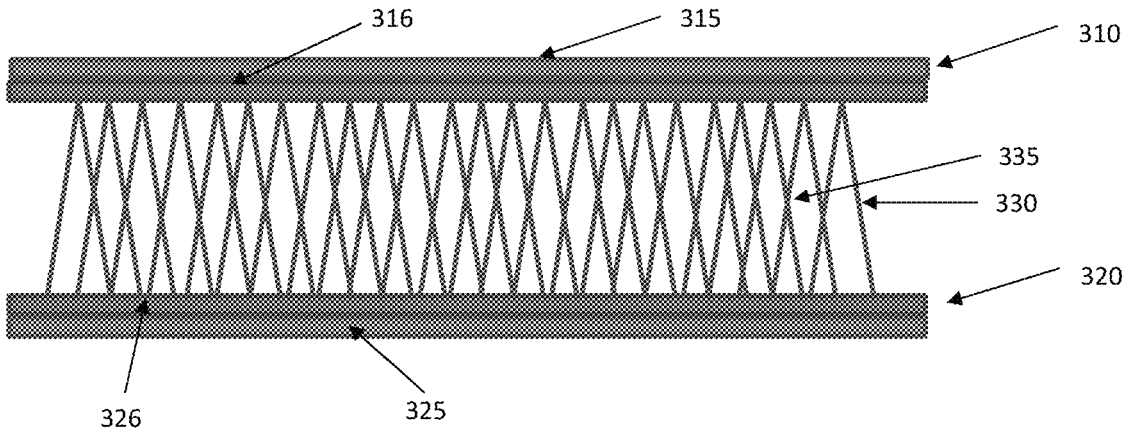
FIG. 4 shows a suitable cross-section for a fabric of the invention, in which each of the first and second surface layers has a main yarn and a plating yarn.

Suitable cross-sections of the fabrics disclosed herein are depicted in FIGS. 3 and 4. FIG. 3 depicts a fabric 200 having plural fabric regions, each fabric region formed from a first surface layer 210 formed from a first set of yarns, a second surface layer 220 formed from a second set of yarns, and a set of spacer yarns 230 between the first and second surface layers 210, 220 in the form of tuck stitches 235. As mentioned, the first and second surface layers 210, 220 (or top and bottom surface layers) and the set of spacer yarns 230 are formed from the same family of thermoplastic polymer materials. For example, the first and second surface layers 210, 220 may be formed from a single main yarn material 215, 225 (which may be formed from a single material or a composite of different materials from the same family of thermoplastic polymer materials). The thickness of the fabric region may be varied by varying formation of the fabric region from at least one of the sets of first, second, and spacer yarns.

In some embodiments of the invention that may be mentioned herein, the first and second sets of yarns may each comprise a main yarn and a plating yarn, where each main yarn forms an outer surface and the plating yarn forms an interior surface of the respective first and second surface layers. As used in this context, the outer surface of the first and second surface layers refers to the exterior side of the respective layer, i.e. the surface of the first and second surface layers that is exposed to the environment or a wearer's body. The inner surface of the first and second surface layers refers to the interior surface of the respective layer, i.e. the surface of the first and second surface layers that is within the fabric product and exposed to the set of spacer yarns, and is not exposed to the environment or body of a wearer. This may be beneficial when the fabric product is intended to have specific functionality. For example, a wicking yarn may be used on an exterior surface that is intended to be in contact with the body of a wearer, to assist with wicking moisture away from a wearer's skin and improve breathability of the fabric product. In contrast, a water repellent yarn might be desirable on an exterior surface that is intended to be exposed to the environment, in order to prevent the fabric product from becoming overly wet or saturated with moisture when worn outside in the rain.

FIG. 4 depicts a further possible embodiment of a fabric 300 according to the invention, where the first and second surface layers 310, 320 are formed from two separate yarns, that is a main yarn 315, 325 and a plating yarn 316, 326, with a set of spacer yarn 330 between the first and second surface layers 310, 320 in the form of tuck stitches 335. It will be appreciated that the main yarns 315, 325 form an outer surface (i.e. the surface in contact with the outer environment) of the respective surface layers 310, 320, while the plating yarns 316, 326 form the inner surface (i.e. the surface pointing to the interior of the fabric 300).

The main yarns 215, 225 in the embodiment of FIG. 3 may be any suitable material or combination of materials (e.g. the main yarns 215, 225 may be a filament/short staple/core spun yarn plied with yarn with or without elastic properties) from the same family of thermoplastic polymer materials. In some embodiments, the main yarns 215, 225 may be selected from yarns that have elastic properties (e.g. mechanical stretch yarns) to stabilise the fabric 200 and retain its shape upon heat treatment from the moulding process. Moreover, the main yarns 215, 225 may have the same or different yarn count for varying the thickness. The set of spacer yarns 230 may be formed from any suitable material—with the thickness of said material (or its elasticity) chosen to suit the desired thickness of the fabric 200 at any given point (optionally in combination with the density of tuck stitches)—from the same family of thermoplastic polymer materials as the main yarns 215, 225. For example, the set of spacer yarns 230 may be formed from an expandable/swellable materials.

In FIG. 4, the first and second sets of yarns may each comprise a main yarn 315, 325 and a plating yarn 316, 326, where each main yarn 315, 325 forms an outer surface and the plating yarn 316, 326 forms an interior surface of the respective first and second surface layers 310, 320. The main yarns 315, 325 may be any suitable material or combination of materials (e.g. any suitable material or combination of materials as described above for FIG. 3) from the same family of thermoplastic polymer materials. The plating yarns 316, 326 may either be selected from any suitable material or combination of materials from the same family of thermoplastic polymer materials as the main yarns 315, 325. In some embodiments, the plating yarns 316, 326 may have elastic or stretch recovery properties or may be selected from an elastic material to stabilise the fabric 300 and retain its shape upon heat treatment from the moulding process. The set of spacer yarns 330 may be formed from any suitable material—with the thickness of said material (or its elasticity) chosen to suit the desired thickness of the fabric 300 at any given point (optionally in combination with the density of tuck stitches)—from the same family of thermoplastic polymer materials as the main yarns 315, 325. For example, the set of spacer yarns 330 may be formed from expandable/swellable materials.

Particular products that may be mentioned herein may include ones where the fabric is patterned to provide one of a bra cup or a bra cookie for making a bra. In such products, the fabric may be patterned to provide one or more bra cup zones or one or more bra cookie zones for making a bra. For example, wherein each bra cup or bra cookie is patterned to have a first, a second, and a third fabric region, the fabric regions having different fabric properties from each other, such that: the first fabric region corresponds to an outer peripheral region of the bra cup or bra cookie and has a lower thickness than the second fabric region; the second fabric region corresponds to a region of the bra cup or bra cookie between the first and third fabric regions and has a lower thickness than the third fabric region; and the fabric third region corresponds to a central region of the bra cup or bra cookie and has a higher thickness than the first and second fabric regions. For example, the first fabric region has a lower thickness than the second fabric region because the first fabric region has a lower tuck stitch density than the second fabric region and/or the first fabric region has a set of spacer yarns with a diameter/thickness smaller than a set of spacer yarns used in the second fabric region.

In the same or an alternative embodiment, the bra cup or bra cookie may be patterned to further have a fourth and a fifth fabric region, such that: the fourth fabric region corresponds to a region of the bra cup or bra cookie between the third and fifth fabric regions and has a thickness lower than the third fabric region; and the fifth fabric region corresponds to an outer peripheral region of the bra cup or bra cookie and has a thickness lower than the fourth fabric region. For example, the fourth fabric region has a higher thickness than the fifth fabric region because the fourth fabric region has a higher tuck stitch density than the fifth fabric region and/or the fourth fabric region has a set of spacer yarns with a diameter/thickness larger than a set of spacer yarns used in the fifth fabric region. An example of this arrangement is depicted in FIG. 2.

The yarns used in each fabric region of the fabric belong to the same family of thermoplastic polymer materials. The family of thermoplastic polymer materials may be polyamides, polyester, polyolefin, and polyurethane. Examples of thermoplastic materials that may be used herein include, but are not limited to, polyesters, nylons, polypropylenes, thermoplastic polyurethanes (TPU), acrylics, blends thereof, and combinations thereof. These materials may form the whole or part of certain yarns that are used in the fabric. That is, they may form blends with other fabric materials. As will be appreciated, the thermoplastic materials need to be present in a sufficient quantity for the moulded shape to be retained after the moulding process has taken place. Therefore, the thermoplastic yarns may be present in an amount of from 10 wt %, 20 wt %, 30 wt %, 40 wt %, 50 wt %, 60 wt %, 70 wt %, 80 wt % or 90 wt %.

In some embodiments, one or more fabric regions comprises a first surface layer formed from a first set of yarns, a second surface layer formed from a second set of yarns, and a set of spacer yarns between the first and second surface layers. The first and/or second yarns may comprise a material with elastic properties, such as at least 10 wt % or, more particularly, 15 wt % of an elastic material. Without wishing to be bound by theory, it is believed that the use of elastic material may help the fabric product to retain its shape, this is because the stretch recovery properties of the elastic material ensure that the shape is maintained; and/or the elastic material reduced the drapeability of the fabric and provides the fabric with structural support, thereby enabling the fabric to maintain its shape. The use of elastic material may also add stretchability to the fabric material, leading to increased wearer comfort. Given this, the use of an elastic material may enable the fabric product to better conform to the body of a wearer. Elastic materials may also be useful in certain specific applications, such as sportswear (e.g. sports bras). The plating yarns (when present) of the first and second sets of yarns may be formed from yarns having elastic properties. For example, the plating yarns may comprise at least 15 wt % of an elastic material.

Figure 5:
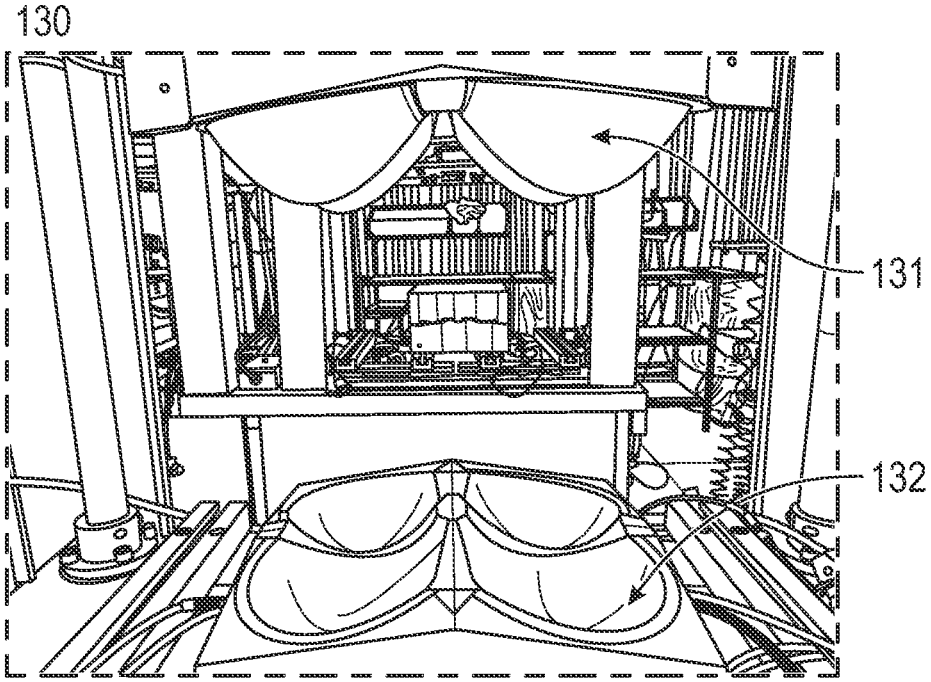
FIG. 5 shows an example of a mould comprising a male component and a female component.
Figure 6:
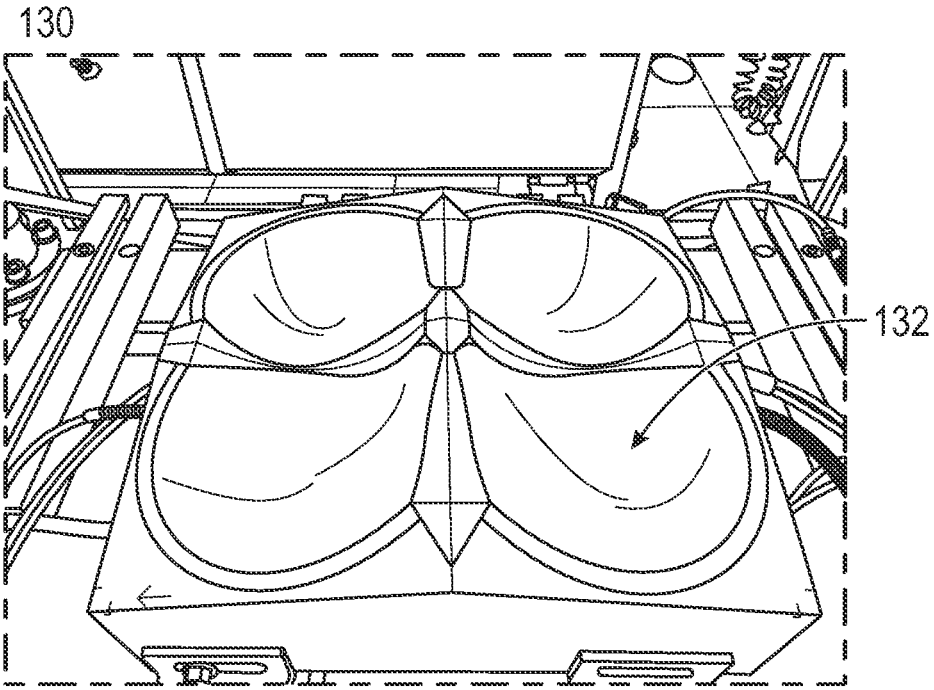
FIG. 6 shows another view of the female component of the mould of FIG. 5.
Figure 7:
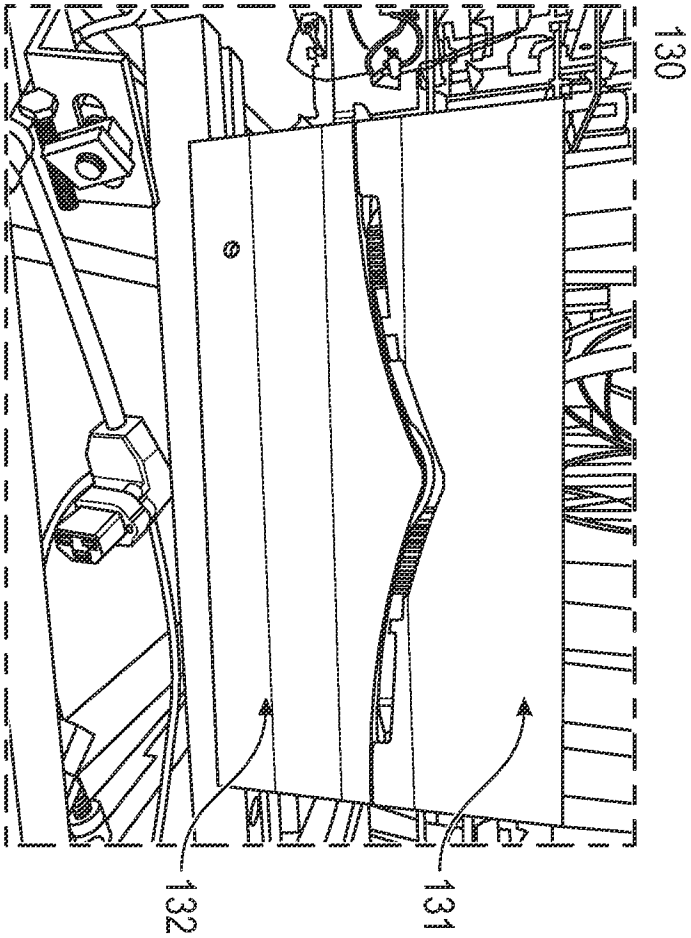
FIG. 7 shows the mould of FIG. 5 with the male component and female component together.

As described above, the fabric is moulded and the fabric regions have different fabric properties from each other. As shown in FIGS. 5 to 7, the fabric is moulded in a moulding process using a mould 130. The mould 130 itself will be constructed from a male component 131 and a female component 132. The mould 130 may be designed to have contours that will vary the compression of the fabric during moulding, enabling the fabric regions to have different densities. The compression pressure applied on the fabric during moulding may range from 0 to 6 bars. The temperature and time used for the moulding will vary depending on the thermoplastic polymer materials used and may be readily determined by a skilled person. For example, a suitable temperature range for the moulding may be from 90 to 220° C. and a suitable time at this temperature for the fabric in the mould may be from 20 to 240 seconds.

The heat from the moulding should be enough to bring the thermoplastic polymer materials of the fabric to their glass transition temperatures, at which point the thermoplastic polymer materials alter from a glass-like rigid solid state to a more flexible state. In this flexible state, the male component 131 and a female component 132 compress the fabric and form it into desirable depth, shape, profile, and contours. More specifically, the male component 131 and a female component 132 vary the compression of the fabric and allows for a desirable mass density variation to be obtained across the entirety of the fabric. In one example, the area required to have the highest mass density can be achieved by applying highest compression pressure at said area of the fabric where the original knitted material (before moulding) is the thickest. By compressing the area with the thickest knitted material of the fabric, the volume at said area is minimized, thus maximizing the mass density. In another example, the area required to have the highest thickness of the original knitted material can be achieved by not applying compression pressure at said area of the fabric. Since the area with the thickest knitted material is not compressed, the thickness and volume are the highest and the mass density is the lowest. In yet another example, two fabric regions have the same thickness of knitted material before moulding. One fabric region is compressed more than the other fabric region during moulding. As a result, the fabric region that is more compressed would be denser and stiffer than the other fabric region. High compression of a fabric region may be desired for the wire fabric region 125 to achieve a stiff bra underwire functionality. Alternatively or additionally, the wire fabric region 125 is made of a material from the same family of thermoplastic polymer materials such that the wire fabric region 125 stiffens in response to heat treatment during the moulding process.

FIG. 8 depicts a moulded bra cup 400 formed from the moulded fabric comprising fabric regions with different fabric properties, such as density, thickness, and/or stiffness. The fabric regions are made of yarns from the same family of thermoplastic polymer materials. The depth in the Z direction is achieved or accentuated through the moulding process and the thickness of the bra cup 400 is varied in both the X and Y directions. Notably, the area of the bra cup 400 in the X direction is thicker than the area of the bra cup 400 in the Y direction.

In some embodiments, the moulding process is a single moulding process to achieve mass density variations in the bra cup 400. Particularly, the moulding process can be used to achieve different fabric properties in different places of the bra cup 400, such as to create the functionality of a bra underwire by the stiff wire fabric region 125 as shown in FIGS. 1 and 2.

In some embodiments, the moulding process is a two-stage moulding process to achieve different properties in different places of the bra cup 400. For example, in the first stage, the fabric is moulded into the bra cup 400. The wire element for creating the wire fabric region 125 is then added to the area of the moulded bra cup 400 where the bra underwire properties are required. The wire fabric region 125 is then moulded in the second stage of the moulding process to integrate the wire fabric region 125 with the moulded bra cup 400.

As will be apparent from the foregoing, the fabric of the invention provides a number of benefits. The fabric has plural fabric region with fabric properties that are varied across the fabric. For example, the thickness of the fabric regions may be varied at any point by varying one or more of the density of tuck stitches and/or the thickness of the spacer yarn that is used to form the tuck stitches. The density of the fabric product may be varied at any point by varying the compression pressure applied to the fabric during moulding. This can be used to achieve certain properties at certain areas of the fabric product, such as to create a bra underwire effect in a bra cup. The yarns, which are made from the same family of thermoplastic polymer materials, may be selected and positioned to provide numerous additional functionalities. For example, wicking properties, breathability properties, water repellent properties, liquid retaining properties, anti-microbial properties, anti-odour properties and/or thermal comfort.

Various embodiments herein describe the fabric product as a bra cup, bra cookie, or bra. The fabric product may include other garments such as shoulder pad or a knee garment (e.g. knee guard).

The invention claimed is:

1. A fabric having variable fabric properties, the fabric comprising:

a plurality of fabric regions disposed across the fabric in a coursewise and walewise direction, each fabric region formed from at least one set of yarns; and the sets of yarns of the fabric regions belonging to a common family of thermoplastic polymer materials, wherein the fabric is moulded and the fabric regions have different thicknesses and/or densities from each other;

wherein the different thicknesses of the fabric regions are formed by variation in at least one of:

density of tuck stitches of the sets of yarns of the fabric regions;

thickness of the sets of yarns of the fabric regions; and knit structure of the fabric regions; and wherein the different densities of the fabric regions are formed by varying compression of the fabric during moulding.

2. The fabric according to claim 1, wherein the fabric regions have different stiffness from each other.

3. The fabric according to claim 1, wherein the knit structure is formed by inlay knitting.

4. The fabric according to claim 1, wherein a fabric region comprises:

a first surface layer formed from a first set of yarns;

a second surface layer formed from a second set of yarns; and a set of spacer yarns between the first and second surface layers.

5. The fabric according to claim 4, wherein each of the first and second sets of yarns comprises an elastic material.

6. The fabric according to claim 4, wherein each of the first and second sets of yarns comprises a main yarn and a plating yarn, the main yarn forming an outer surface and the plating yarn forming an interior surface of the respective first and second surface layers.

7. The fabric according to claim 6, wherein the plating yarn of each of the first and second sets of yarns has elastic properties.

8. The fabric according to claim 1, wherein the fabric regions are arranged to provide a bra cup or a bra cookie for making a bra.

9. The fabric according to claim 8, wherein the fabric regions comprise a first, a second, and a third fabric region, such that:

the first fabric region corresponds to an outer peripheral region of the bra cup or bra cookie and has a lower thickness than the second fabric region;

the second fabric region corresponds to a region of the bra cup or bra cookie between the first and third regions, and has a lower thickness than the third fabric region; and the third fabric region corresponds to a central region of the bra cup or bra cookie and has a higher thickness than the first and second fabric regions.

10. The fabric according to claim 8, wherein the fabric regions comprise a wire fabric region that has been stiffened from moulding, the wire fabric region arranged for supporting a user's breast.

11. The fabric according to claim 1, wherein the fabric regions are arranged to provide a knee garment.

12. A garment comprising a fabric having variable fabric properties as defined in claim 1.

13. The garment according to claim 12, wherein the garment is a bra or knee garment.

* * * * *